US005853301A

United States Patent [19]

Wang

[11] Patent Number: 5,853,301

[45] Date of Patent: Dec. 29, 1998

[54] POLARITY FUSE PLUG

[76] Inventor: Lien-Sheng Wang, 8F-2, No. 8, Alley 10, Lane 658, Section 2, Chung Hsing Rd., Chutung, Hsinchu Hsien, Taiwan

[21] Appl. No.: 715,804

[22] Filed: Sep. 19, 1996

[51] Int. Cl.[6] ..... H01R 13/68

[52] U.S. Cl. ..... 439/622

[58] Field of Search ..... 439/622, 621

[56] References Cited

U.S. PATENT DOCUMENTS

| | | | |
|---|---|---|---|
| 4,585,922 | 4/1986 | Berenson | 439/447 |
| 5,295,859 | 3/1994 | Kawai et al. | 439/447 |
| 5,435,755 | 7/1995 | Chien et al. | 439/622 |
| 5,451,173 | 9/1995 | Mai | 439/622 |
| 5,457,445 | 10/1995 | Su | 439/622 |
| 5,637,017 | 6/1997 | Hsu | 439/622 |

*Primary Examiner*—Gary F. Paumen

*Attorney, Agent, or Firm*—Beveridge, DeGrandi, Weilacher & Young, LLP

[57] ABSTRACT

An improved polarity fuse plug. The plug includes an outer shell, an inner plug, 2 electric conductors, a concave shaped butterfly plate and a water proof chip. The outer shell is a flat stand and the inner plug holds each electric conductor separately. One of the electric conductors is connected to the fuse and the end of the other electric conductor is connected to the power cable. There is a concave shaped flume on the side of the fuse box and inside of the box has the concave shaped butterfly plate plugged onto it. The end of the concave shaped butterfly plate is connected to the power cable so as to avoid exposing the power cable when the fuse box is opened. Inside the plug are 2 power cables and a cable separation boad installed in order to strengthen the insulation. Also both the outer shell and the inner plug that are facing each other have a convex slot in order to hold a water proof chip to prevent water leaking in and to prevent leakage of high voltage to secure safety.

6 Claims, 3 Drawing Sheets

POLARITY FUSE PLUG

FIELD OF INVENTION

This present invention is related to an improved structure of a polarity fuse plug to separate the two electric conductors and allow a water proof chip to be put in the power cable entrance slot to make the plug water proof and to prevent shock from shorting of high voltage electricity.

BACKGROUND OF THE INVENTION

The polarity fuse plug that is conventionally used has a set specification and size, including one outer shell and an inner plug and the top of the inner plug has 2 electric conductors and the end of one of the electric conductors is connected to the power cable and the other electric conductor is connected to the fuse. The other side of the fuse has an electric stand and the end of the electric stand is connected to non-insulated wire in order to have the electric conduction function. Because the power cable is connected to either the electric conductor or the electric conductor stand, non-insulated wire is bare. Therefore, if water goes into the plug, this will cause a high voltage electricity accident and is very dangerous. At the same time the electric conductor stand is normally directly connected to the fuse and is not connected to the inner plug. This will cause a short if the fuse is disconnected while pulling the power cable and cause the plug to be out of order. Therefore there is another method of installing the electric cable stand in which the electric conductor stand is directly connected to the bottom of the fuse. Even though this method of installation can solve the above problem, if the outer shell of the fuse box is opened, both the electric conductor stand and the non-insulated cable will be shown and is very dangerous. Because of this, this present invention was developed after years of accumulated experience in order to reach the water proof, safer and more practical polarity fuse plug of the present invention.

SUMMARY OF THE INVENTION

The main object of the present invention is to provide a safe and improved structure of the polarity fuse plug. On the side of the inner plug of the fuse slot, a concave shaped slot is formed in which the similar concave shaped butterfly plate can be set in. The end of the concave shaped butterfly plate's power cable to be installed across so that when the fuse box is opened, the non-insulated wire or the concave shaped butterfly plate cannot be seen and to meet the need of safety.

The second object of the present invention is to reveal a kind of improved structure of the polarity fuse plug, in which there is a cable separation board installed in the proper place of the inner plug where the cable separation board can separate the positive and negative sides of the power cable in order to avoid the electricity leakage caused by the positive and negative sides when the water goes through.

Another object of the present invention is to show a kind of water proof improved structure of the polarity fuse plug, where the inner plug and the end of the outer shell has attached a water proof chip closely to it to prevent water from going in.

For these reasons and in order to further understand the structure and characteristic of the present invention, herewith is presented a detailed and clear illustration together with the accompanied drawings:

BRIEF DESCRIPTION OF THE DRAWINGS AND THEIR COMPONENT NUMBERS (A) The Drawings FIG. 1 is an analytical figure of the structure of this invention.

(B) The Component Numbers

| | | | |
|---|---|---|---|
| 10 | Outer shell | 113 | Concave shaped slot |
| 101 | Penetration slot | 12 | Electric conductor |
| 102 | Fuse cover | 13 | Electric conductor |
| 103 | Convex slot | 14 | Power cable |
| 104 | Convex slot | 15 | Fuse |
| 11 | Inner plug | 16 | Cable separation board |
| 110 | Electric conductor slot | 20 | Concave shaped butterfly plate |
| 111 | Insertion slot | 21 | Water proof chip |
| 112 | Fuse slot | 211 | Go through hole |

DETAILED DESCRIPTION OF THE INVENTION

Figure 1:
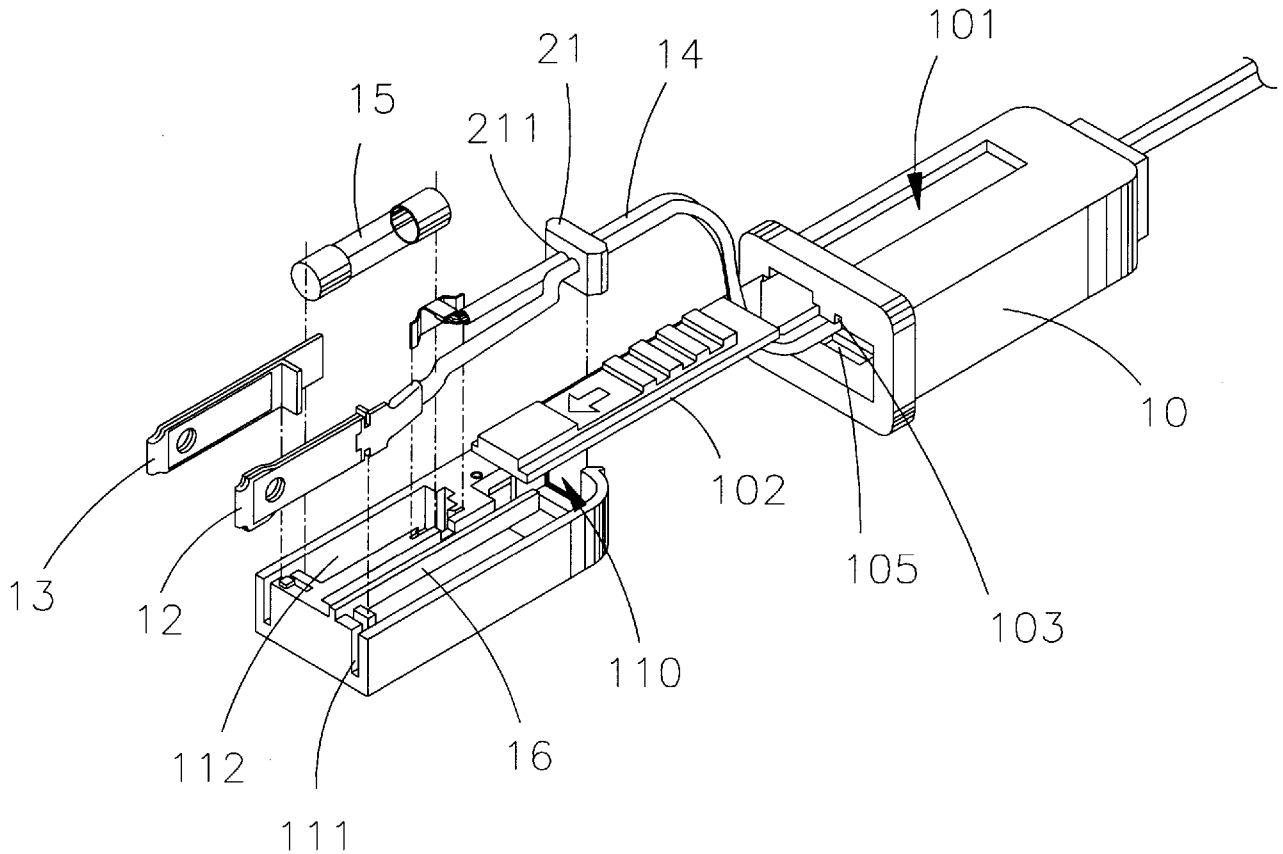

Please see FIG. 1. It includes one outer shell 10 and an inner plug 11. The outer shell 10 has on top of it a through slot 101 for a fuse 102 to penetrate through and has on the bottom a fit slot 105. The inner plug 11 is not covered on top and can fit into the outer shell 10 and there is a concave spot at the bottom in the proper place (not shown in the figure). When the inner plug 11 is placed in the outer shell 10, the concave spot fits into fit hole 105 at the bottom of the outer shell 10, so that the outer shell 10 and the inner plug 11 are steadily connected. At one end of the inner plug 11, an electric conductor slot 110 is located which receives a power cable. The other end of the inner plug 11 has an opening on each side and each opening extends into the inner two sides where an insertion slot 111 and a fuse slot 112 are formed. These openings allow the electronic conductor 12 and 13 to be inserted, and the end of the electronic conductor 12 is connected to one of two non-insulated portions of a power cable 14. An electric conductor 13 is disposed in the fuse slot 112 of the inner plug 11 and a fuse 115 inside the fuse slot 112 contacts the electric conductor 13. There is a cable separation board 16 in between the electric conductors 12 and 13 and the cable separation board 16 is raised above the top surface of the inner plug 11. A cross convex slot 103 is located in the outer shell 10 at a position corresponding to that of the cable separation board 16. The convex slot 103 allows the cable separation board 16 to be closed tightly and separates the inner plug 11 into two spaces.

Figures 2, 2A:
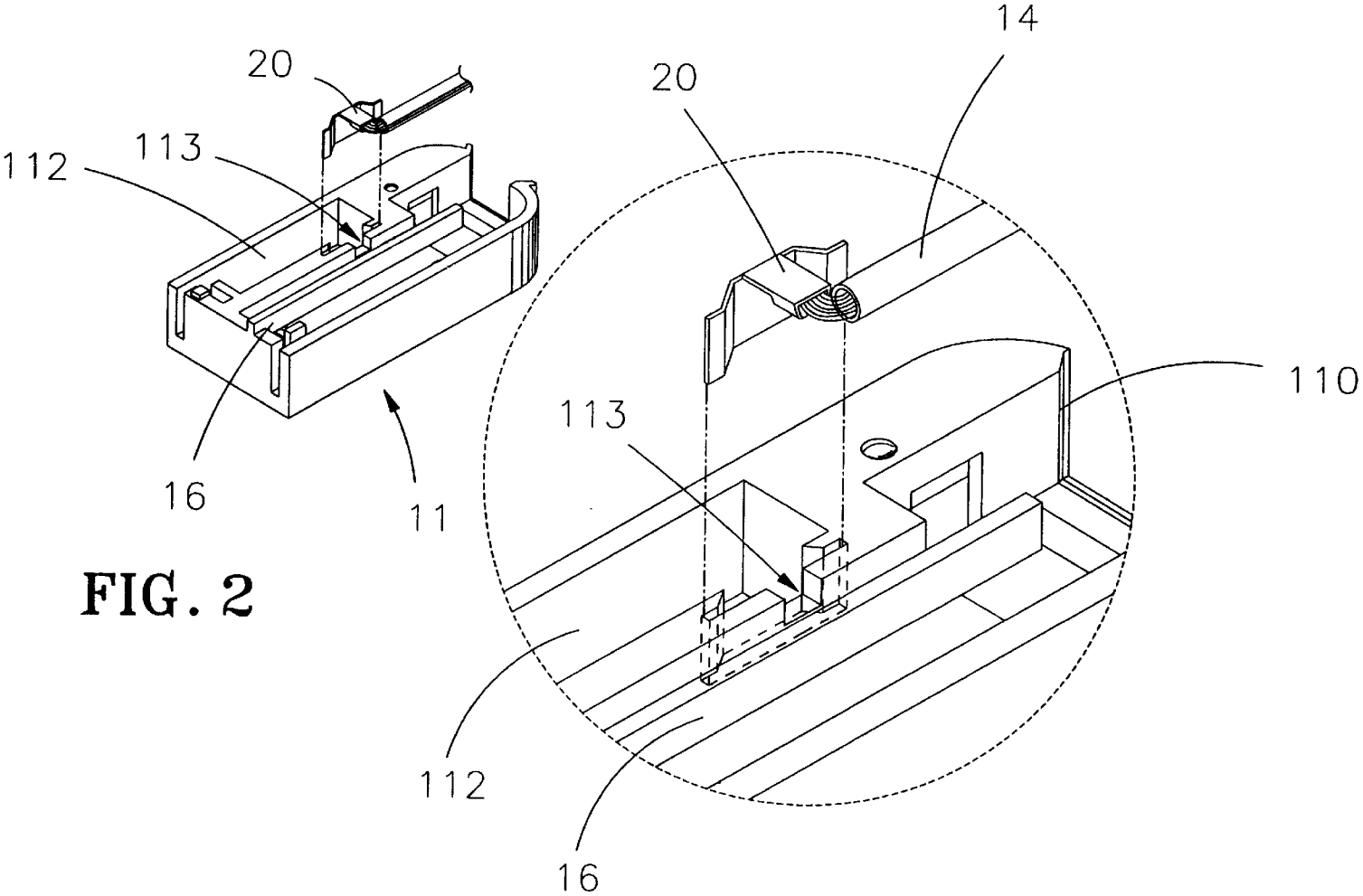
FIG. 2 is a partial indication figure of the structure of this invention.
FIG. 2A illustrates an enlarged view of a portion of FIG. 2.

FIG. 2 is a partial indication diagram of the structure, while FIG. 2A is an enlarged view of a portion of FIG. 2. The side of the fuse slot 112 has a concave shaped slot 113. A concave shaped butterfly plate 20 is received into the two sides of the concave shaped slot 113, and the two sides contact the inner surface of the concave shaped slot 113 and is touching the fuse inside the fuse slot 112 (as FIG. 3 shows). On top of the concave shaped butterfly plate 20 is a main body portion, bent with respect to the concave shaped butterfly plate 20 to be perpendicular. The concave shaped butterfly plate 20 is connected to the other non-insulated wire portion of the power cable 14 at the main body portion of the concave shaped butterfly plate 20 and thus is safer and avoids dangerous accidents when the whole set is completed and while opening the cover of the fuse box 102. The concave shaped butterfly plate 20 and the non-insulated wire at the end of it can avoid to be covered by the position of the fuse cover 102 and the other parts of the outer shell 12 or can prevent it from being bare when the cover of the fuse box 102 is opened. Also because the main body portion of the concave shaped butterfly plate 20 is inserted into a groove defined by the concave shaped slot 113, the concave shaped butterfly plate 20 will not cause the fuse 15 to be separated because of outside pulling forces applied to the power cable 14 and thus can be stabilized and kept connected to the fuse 15. At the same time, please see as indicated in FIG. 1, because the two non-insulated wires of the power cable 14 are connected to the electric conductor 12 and the bottom edge of the main body of the concave shaped butterfly plate 20 respectively, which indicates the positive side and the negative side of the plug respectively. While installing the power cable 14, the positive and negative sides of the plug should be separated by the cable separation board 16 in order to prevent high voltage electricity shock caused by electricity flow between the positive and negative sides when water happens to go through the inner plug 11.

FIG. 3 is an indication diagram of the water proof structure. There is an electronic conductor slot 110 at the end of the inner plug 11 and the two sides of the electronic conductor slot 110 expand from inside out. The two sides form a slanted side respectively which allows a part of the structure of the multi-angled water proof chip 21 to be inserted. The water proof chip 21 is formed from a soft and slightly flexible material. In the middle, a go-through hole 211 is defined to allow the power cable 14 to go through (as indicated in FIG. 1). At the same time the bottom inner side of the outer shell 10 has a two sided slanted convex slot 104. When the water proof chip 21 is pressured by insertion of the inner plug 11 in the outer shell 10, the partial structure of the other side of the water proof chip 21 engages the convex slot 104 at the bottom of the outer shell. This allows the inner plug 11 to add pressure to the outer shell 10 in order for the two to be tightly sealed to prevent water from going through and thus, the function of water proofing is obtained.

Figure 3A:
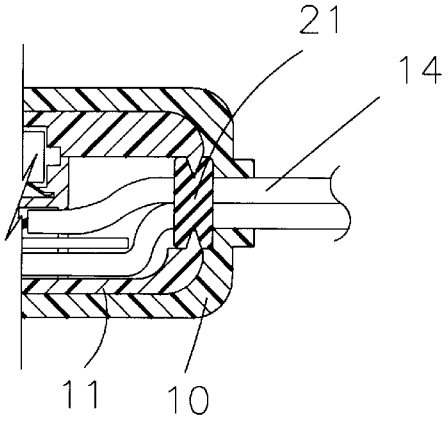
FIG. 3A is the example of the water proof structure of this invention.

FIG. 3A is a practical example of another embodiment of the water proof structure. The two sides of the water chip 21 has a canned shaped design inside and the sides of the main body at the electronic conductor slot 110 has a similar co-operative design to that of the canned shape design of the water proof chip 21. By this, the water proof chip 21 can be inserted into the inner plug 11 and the other inner side of the outer shell 10 can be inserted into the convex slot 104 and in which water can be prevented from going through.

Figure 3B:
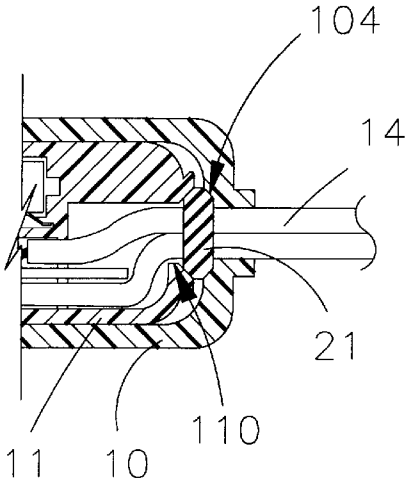
FIG. 3B is another example of a waterproof structure according to the invention.
Figure 3:
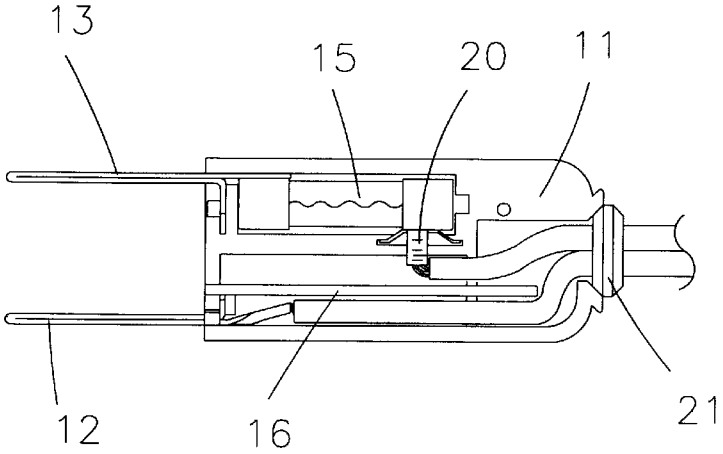
FIG. 3 is the indication figure of the water proof structure of this invention.

FIG. 3B is an alternate embodiment of a water proof plug according to the invention.

In view of the above explanation, the invention is an improved structure of the polarity fuse plug and has practicality and creativity not yet seen in any publication.

The above explanation can only be used to better understand the present invention and cannot be limited thereby. The changes or modifications made to the invention according to the applied patent, is still included in the spirit and scope of the present invention.

I claim:

1. A polarity fuse plug, comprising:

an inner plug defining therein a fuse slot for receiving a fuse, a first conductor slot in communication with the fuse slot, a concave shaped slot in communication with but separated from the fuse slot, and a second conductor slot separated from the first conductor slot and the fuse slot;

an outer shell encasing the inner plug, the outer shell having an openable fuse cover for exposing the fuse slot to receive a fuse;

a first conductor positioned in the first conductor slot;

a second conductor positioned in the second conductor slot; and a concave shaped butterfly plate having a first portion for contacting a lead of an input wire, and a second portion for contacting a fuse received within the fuse slot, the second portion having two end sections and a center section therebetween, the two end-sections being positioned within the concave shaped slot such that, when the fuse cover in the outer shell is opened, only the center section of the concave shaped butterfly plate is exposed and is adapted to resiliently engage the fuse.

2. A polarity fuse plug as recited in claim 1, wherein the second conductor slot is separated from the first conductor slot and the fuse slot by a separation board, such that a first lead of an input wire is positioned on a first side of the separation board to contact the first portion of the concave shaped butterfly plate, and a second lead of an input wire is positioned on a second side of the separation board opposite the first side to contact the second conductor.

3. A polarity fuse plug as recited in claim 2, wherein a portion of the separation board extends above a top surface of the inner plug; and the outer shell defines therein a slot for receiving the extended portion of the separation board.

4. A polarity fuse plug as recited in claim 1, further including an input wire slot for receiving two or more leads of an input wire, the input wire slot being in communication with the concave shaped slot and the second conductor slot.

5. A polarity fuse plug as recited in claim 4, further including a water proof chip positioned in the input wire slot to prevent water leaking into the input wire slot.

6. A polarity fuse plug as recited in claim 5, wherein the input wire slot includes a convex portion for securing the water proof chip.

* * * * *